US010138566B2

(12) United States Patent
Salsa et al.

(10) Patent No.: US 10,138,566 B2
(45) Date of Patent: Nov. 27, 2018

(54) SEALING ANODIZED ALUMINUM USING A LOW-TEMPERATURE NICKEL-FREE PROCESS

(71) Applicant: MacDermid Acumen, Inc., Waterbury, CT (US)

(72) Inventors: Sara Salsa, Bellinzago Novarese (IT); Patrizia Angeli, Invorio (IT)

(73) Assignee: MacDermid Acumen, Inc., Waterbury, CT (US)

( * ) Notice: Subject to any disclaimer, the term of this patent is extended or adjusted under 35 U.S.C. 154(b) by 83 days.

(21) Appl. No.: 15/405,417

(22) Filed: Jan. 13, 2017

(65) Prior Publication Data

US 2018/0202061 A1 Jul. 19, 2018

(51) Int. Cl.

| | |
|---|---|
| ***C25D 11/24*** | (2006.01) |
| ***B05D 1/36*** | (2006.01) |
| ***C23C 22/83*** | (2006.01) |

(52) U.S. Cl.
CPC ..... *C25D 11/246* (2013.01); *B05D 1/36* (2013.01); *C23C 22/83* (2013.01)

(58) Field of Classification Search
None
See application file for complete search history.

(56) References Cited

U.S. PATENT DOCUMENTS

| | | | | |
|---|---|---|---|---|
| 3,175,881 A | | 3/1965 | Chiola et al. | |
| 3,849,264 A | * | 11/1974 | Weber | C25D 11/246 205/50 |
| 3,900,370 A | * | 8/1975 | Germscheid | C25D 11/246 205/204 |
| 4,220,485 A | | 9/1980 | Howell et al. | |
| 4,786,336 A | | 11/1988 | Schoener et al. | |
| 4,801,360 A | | 1/1989 | Tanner | |
| 5,775,892 A | * | 7/1998 | Miyasaka | C25D 5/44 123/193.2 |
| 5,891,269 A | * | 4/1999 | Koerner | C25D 11/18 148/272 |
| 5,935,656 A | * | 8/1999 | Koerner | C25D 11/246 106/14.12 |
| 6,193,815 B1 | | 2/2001 | Wada et al. | |
| 6,447,665 B1 | * | 9/2002 | Johnson | C25D 11/18 148/272 |

FOREIGN PATENT DOCUMENTS

| | | |
|---|---|---|
| CA | 2226418 | 1/1997 |

* cited by examiner

*Primary Examiner* — Michael P. Rodriguez
(74) *Attorney, Agent, or Firm* — Carmody Torrance Sandak & Hennessey LLP

(57) ABSTRACT

The inventive two-step process operates at low temperature, without any toxic heavy metals, to provide excellent sealing on anodized aluminum substrates, especially those aluminum substrates comprising silicon. The first step of the process seals the anodized surface and the second step passivates the anodized surface. The process allows for corrosion resistance in anodized aluminum and anodized aluminum alloys to be achieved that is comparable to traditional nickel based sealants, without the toxicity of nickel. The process additionally does not require any excessive temperatures, as required by hot water sealing processes. The composition used for the sealing step comprises soluble lithium ions, fluoride ions, and preferably, a complexing agent comprising phosphines, phosphonates and/or polymers of acrylic acid. The composition used for the passivation step comprises metal ions and preferably a complexing agent comprising phosphines, phosphonates and/or polymers of acrylic acid.

25 Claims, No Drawings

SEALING ANODIZED ALUMINUM USING A LOW-TEMPERATURE NICKEL-FREE PROCESS

FIELD OF THE INVENTION

The invention generally relates to a method for sealing anodized aluminum surfaces to protect the surfaces from corrosion.

BACKGROUND OF THE INVENTION

Anodizing is a process which has long been used to protect the surface of aluminum components from corrosion. The process consists of making a component anodic in an acidic solution. A typical anodizing process consists of degreasing, pickling/etching (or brightening), desmutting, anodizing, sealing and aging steps.

The process of anodization leads to the formation of a porous oxide layer on the aluminum surface which may have a thickness in the range of 3 to 25 microns depending on the field of application. Because the oxide layer is porous, it is necessary to seal the pores to prevent corrosion. One method uses hot water (typically used at boiling point) for sealing porous oxide layers. However, the required immersion time to achieve complete sealing of the surface is between 2 and 3 minutes per micron of oxide coating, which can lead to overall lengthy immersion times. Additionally, using hot water for sealing is not energy efficient and there are obvious safety hazards involved with the use of boiling water. The oxide layer is often not homogeneous on aluminum alloys with high amounts of silicon. Due to the non-uniformity of the oxide layer, such alloys cannot be successfully treated using hot water because the resulting corrosion performance will not be adequate.

In order to address the problems associated with hot water sealing processes, low temperature sealing processes have been developed using nickel salts, typically using nickel fluoride. These processes operate at low temperatures, typically less than 30° C., and involve a contact time of about 1 minute per micron of oxide on the aluminum surface. The sealing process is thought to be accomplished via the formation of a complex of nickel aluminum-fluoride salt in the pores of the anodized coating.

Nickel based sealing processes have obvious advantages in terms of production throughput and energy efficiency. Furthermore, using nickel based sealing processes provides good corrosion resistance, especially for those aluminum alloys higher in silicon. However, the use of nickel is becoming increasingly restricted due to its carcinogenic properties; therefore a low temperature sealing process that does not contain nickel is desirable for providing corrosion resistance on anodized aluminum surfaces. Additionally, because of the toxicity of nickel, measures must be taken to carefully treat the wastewater from nickel based sealing processes, which can be very expensive.

There have already been attempts to produce nickel-free, low temperature sealing systems, but none of these at present effectively addresses the problems associated with treatment of high silicon alloys. For example, Canadian Patent 2,226,418 to Koerner et al. proposes the use of a lithium fluoride based immersion process (optionally containing molybdate, vanadate or tungstate ions) prior to a conventional hot sealing process (80-100° C.). The process is claimed to reduce the immersion time required in the hot process and provide effective sealing of anodized metals. However, temperatures in excess of 80° C. are still required.

U.S. Pat. No. 4,786,336 to Schoener et al. describes a low temperature (40° C.) process using a composition based on fluoro-zirconates or fluoro-tungstates in combination with silicate. However, this process does not produce satisfactory results on anodized aluminum alloys with high silicon content.

There are many industrial applications in which aluminum alloys have higher than 1% silicon where corrosion resistance is critical. Brake calipers are an excellent example of an aluminum alloy component that may comprise a high percentage of silicon, where a sufficiently sealed surface will be paramount to the corrosion resistance of the final product. Accordingly, there is a need for a nickel-free, low temperature sealing process suitable for all anodized aluminum alloys including high silicon alloys.

SUMMARY OF THE INVENTION

The current invention provides a two-step process wherein the composition of the first step comprises lithium ions and fluoride ions and the composition of the second step comprises tungsten, molybdenum, titanium, zirconium, or vanadium ions. This process allows for successful sealing of anodized aluminum alloys, including alloys with high silicon content. The sealing of the anodized aluminum alloys is achieved at a low temperature, reduced immersion time and in the absence of nickel in the sealing composition. Surfaces treated with the inventive process have excellent corrosion resistance and performance equivalent to traditional nickel based cold-sealing processes in standardized testing.

The current invention is summarized as a method for sealing an anodized aluminum or anodized aluminum alloy surface comprising:

(i) contacting the anodized surface with a sealing composition comprising a source of lithium ions, a source of fluoride ions, and a complexing agent, followed by;

(ii) contacting the anodized surface with a passivation composition wherein the passivation composition comprises a source of metal ions and a complexing agent;

wherein the surface of the anodized aluminum or anodized aluminum alloy becomes corrosion resistant.

DETAILED DESCRIPTION OF THE PREFERRED EMBODIMENTS

According to this invention, a method is provided for the low temperature sealing of the surface of anodized aluminum and anodized aluminum alloys, including those with high-silicon content. The method involves two steps that result in excellent corrosion resistance of anodized aluminum components that do not comprise nickel and can be carried out at low temperatures. The first step seals the anodized surface and the second step passivates the surface to impart excellent corrosion resistance to the surface.

The inventive process is more environmentally friendly and energy efficient in comparison to cold-sealing nickel and hot water sealing processes. The process according to the invention can be used for sealing the surface of a wide variety of anodized aluminum and anodized aluminum alloys, including those with silicon content of 1% or higher. The process can be used for both colored and uncolored anodized surfaces of aluminum and aluminum alloys. The anodized surfaces of aluminum and aluminum alloys are colored by traditional processes such as integral coloring, absorptive coloring, reactive coloring, electrochemical coloring, or interference coloring. The current invention additionally reduces the bleeding of such colors that occurs with high temperature processes.

The anodized aluminum component to be sealed is immersed in a sealing composition containing a soluble lithium salt sufficient to provide a lithium ion concentration of between 100 and 2000 ppm, preferably between 300 and 800 ppm. The lithium ions are preferably provided from lithium-acetate or lithium-fluoride, but any soluble salt of lithium can be used. The sealing composition must also contain fluoride ions in a concentration of between 100 and 2000 ppm of fluoride, preferably between 150 and 800 ppm.

In a preferred embodiment the lithium ions are supplied from lithium acetate (anhydrous), wherein the lithium acetate is present in the sealing composition in a concentration of between 3000 to 8000 ppm and the fluoride ions are supplied from potassium-fluoride (anhydrous), wherein the potassium-fluoride is present in the composition in a concentration of between 450 to 2400 ppm.

The sealing composition will also preferably contain a complexing agent. Suitable complexing agents include phosphines, phosphonates and polymers of acrylic acids. The complexing agent may be present in the sealing composition in a concentration of between 10 to 10000 ppm, preferably between 50 to 500 ppm. The complexing agent in the sealing solution is preferably selected from the group comprising phosphino-carboxylic acid polymers, phosphono-carboxylic acid polymers and mixtures thereof. A particularly preferred complexing agent is 2-phosphonobutane-1,2,4-tricarboxylic acid (Structure 1). Other suitable complexing agents include polymers of acrylic acid which may be used at similar concentrations to the phosphines and phosphonates. Acrylic acid polymers with a molecular weight between 1,000 and 10,000 are particularly useful in the current invention. A homopolymer of acrylic acid with a molecular weight around 4500 is most preferred.

Structure 1

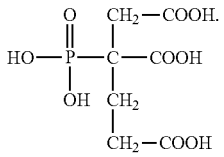

The operating temperature of the sealing composition is between 20° C. and 60° C., preferably between 35° C. and 40° C. The pH of the sealing composition is between 5 and 8, preferably between 6 and 7. The immersion time in the sealing composition is between 0.75 and 1.25 minutes per micron of anodized coating, and most preferably about 1 minute per micron. After the sealing step, the components are rinsed and transferred to a passivating step.

Following the sealing treatment step as outlined above, the aluminum components are transferred to a second composition for passivation. The passivation composition comprises metal salts which provide metal ions selected from the group comprising tungsten, titanium, zirconium, and mixtures thereof. Preferred examples of the metal salts are ammonium metatungstate, ammonium molybdate, ammonium tungstate, ammonium vanadate, zirconium acetate, titanium oxalate and mixtures thereof. The most preferred metal salt is ammonium tungstate. The metal salts are present in the passivation composition in a concentration of between 200 and 8000 ppm or more preferably between 1000 and 4000 ppm. The metal ions are preferably present in the passivation composition at a concentration between 100 and 3000 ppm.

The passivation composition preferably contains a complexing agent. Suitable complexing agents include phosphines and phosphonates. The phosphine and phosphonate complexing agent(s) may be present in the passivation composition in a concentration of between 10 and 10000 ppm, preferably at a concentration of between 50 and 500 ppm. The complexing agent in the passivation composition is preferably selected from the group comprising phosphino-carboxylic acid polymers, phosphono-carboxylic acid polymers and mixtures thereof. A particularly preferred phosphonate complexing agent is nitrilotrimethylene phosphonic acid (Structure 2). Other suitable complexing agents include polymers of acrylic acid which may be used at similar concentrations to the phosphine and phosphonate complexing agents. Acrylic acid polymers with a molecular weight between 1,000 and 10,000 are particularly useful in the current invention. A homopolymer of acrylic acid with a molecular weight around 4500 is most preferred.

Structure 2

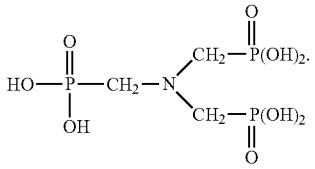

The operating temperature of the passivation composition is between 40° C. and 80° C., preferably at a temperature of between 55° C. and 65° C. The pH of the passivation composition should be between 4 and 8, preferably between 5.5 and 7.0. The immersion time in the passivation composition is between 5 and 35 minutes, preferably from 10 to 25 minutes. Following the passivation step, the components are rinsed and dried.

The invention is illustrated by the following non-limiting examples:

Example 1

Four Q-panels of aluminum alloy 6060 (maximum 0.3-0.6% silicon) were anodized with a thickness of 20 microns of oxide. Two of the Q-panels were dipped into black organic color for 10 minutes (8 g/l of Sanodal Black 2MLW) at 50° C. and the other two panels were left in a natural condition.

One black anodized panel and one natural panel were dipped in a conventional nickel fluoride based sealant for 10 minutes at 28° C.

Nickel ion concentration: 1.2-2 g/l

Fluoride ion concentration: 500 ppm

One black anodized panel and one natural panel were dipped in a sealing composition, as described in the sealing step of the current invention, comprising:

Lithium acetate: 5000 ppm

Fluoride ions: 400-800 ppm

Complexing agent (Structure 1): 250 ppm

The sealing composition has a pH between 6.0 and 7.0 and the panels were immersed for 20 minutes at 35° C.

Then panels were then immersed in a passivation solution of the current invention, comprising:

Ammonium metatungstate: 2000 ppm

Complexing agent (Structure 2): 250 ppm

The passivation composition has a pH between 5.5 and 7.0 and the panels were immersed for 20 minutes at 60° C.

Following the passivation step, the visual aesthetics of the black panels were compared. It was found that the panel treated with the two-step process of the invention gave visually identical results to that obtained from the conventional nickel containing sealing process.

The natural panels were analyzed using a weight loss test after dipping in chromic/sulfuric acid as described in test UNI EN 12373-7. The weight loss from the panel processed using the inventive process was similar to that obtained from the conventional nickel sealing process.

The natural panels were additionally tested using an acetic acid salt spray test according to UNI EN ISO 9227. Again, the results obtained from the inventive process were similar to that obtained from the conventional nickel sealing process. The panels were also tested by dipping them in 50% nitric acid for 24 hours at 20° C. Again, the results using the inventive process were similar to that of the conventional nickel sealing process.

Example 2

Aluminum alloy components comprising 5% silicon were anodized with a thickness of 20 microns of oxide. The components were then treated and tested as described in example 1. In all cases, similar results were obtained with the inventive process compared to the conventional nickel sealing process.

Example 3

Aluminum alloy components comprising 7% silicon were anodized with a thickness of 20 microns of oxide. The components were then treated and tested as described above, in example 1. Similar results were obtained with the process of the invention and the conventional nickel containing sealing process.

The invention is generally disclosed herein using affirmative language to describe the numerous embodiments. The invention also specifically includes embodiments in which particular subject matter is excluded, in full or in part, such as substances or materials, method steps and conditions, protocols, procedures, assays or analysis. Thus, even though the invention is generally not expressed herein in terms of what the invention does not include, aspects that are not expressly included in the invention are nevertheless disclosed herein.

A number of embodiments of the invention have been described. Nevertheless, it will be understood that various modifications may be made without departing from the spirit and scope of the invention.

The invention claimed is:

1. A method for sealing an anodized aluminum or anodized aluminum alloy surface comprising:

(i) contacting the anodized surface with a sealing composition comprising a source of lithium ions, a source of fluoride ions, and a complexing agent, followed by;

(ii) contacting the anodized surface with a passivation composition wherein the passivation composition comprises a source of metal ions and a complexing agent;

wherein the surface of the anodized aluminum or anodized aluminum alloy becomes corrosion resistant, and wherein the temperature of the passivation composition is less than 80° C.

2. The method according to claim 1, wherein the complexing agent in the sealing composition is selected from the group consisting of phosphines, phosphonates, acrylic acid polymers, and mixtures thereof.

3. The method according to claim 2, wherein the complexing agent is in the sealing composition in a concentration from 50 ppm to 500 ppm.

4. The method according to claim 1, wherein the complexing agent in the passivation composition is selected from the group consisting of phosphines, phosphonates, acrylic acid polymers, and mixtures thereof.

5. The method according to claim 4, wherein the complexing agent is in the passivation composition in a concentration from 50 ppm to 500 ppm.

6. The method according to claim 2, wherein the complexing agent in the sealing composition is selected from the group consisting of phosphino-carboxylic acid polymers, phosphono-carboxylic acid polymers and mixtures thereof.

7. The method according to claim 2, wherein the complexing agent is 2-phosphonobutane-1,2,4-tricarboxylic acid.

8. The method according to claim 4, wherein the complexing agent in the passivation composition is selected from the group consisting of phosphino-carboxylic acid polymers, phosphono-carboxylic acid polymers and mixtures thereof.

9. The method according to claim 4, wherein the complexing agent in the passivation composition is nitrilotrimethylene phosphonic acid.

10. The method according to claim 1, wherein the aluminum alloy comprises at least 1% silicon.

11. The method according to claim 10, wherein the aluminum alloy comprises at least 5% silicon.

12. The method according to claim 11, wherein the aluminum alloy comprises at least 7% silicon.

13. The method according to claim 1, wherein the metal ions in the passivation composition are selected from the group consisting of tungsten, titanium, molybdenum, vanadium, zirconium, and mixtures thereof.

14. The method according to claim 13, wherein the metal ions are in the passivation composition at a concentration of between 100 ppm and 3000 ppm.

15. The method according to claim 13, wherein the metal ions in the passivation composition are tungsten.

16. The method according to claim 13, wherein the metal ions are provided by a metal salt selected from the group consisting of ammonium metatungstate, ammonium molybdate, ammonium tungstate, ammonium vanadate, zirconium acetate, titanium oxalate and mixtures thereof.

17. The method according to claim 16, wherein the metal salt providing the metal ions is ammonium metatungstate.

18. The method according to claim 1, wherein the lithium ions are in the sealing composition at a concentration between 300 ppm and 800 ppm.

19. The method according to claim 1, wherein the fluoride ions are in the sealing composition at a concentration between 150 ppm and 800 ppm.

20. The method according to claim 1, wherein the temperature of the sealing composition is between 20° C. and 60° C.

21. The method according to claim 1, wherein the temperature of the passivation composition is between 40° C. and 65° C.

22. The method according to claim 1, wherein a duration for contacting the anodized surface with the sealing composition is between 0.75 min and 1.25 min per micron of anodized coating on the aluminum alloy surface.

23. The method according to claim 1, wherein the pH of the passivation composition is between 5.5 and 7.0.

24. The method according to claim 1, wherein the anodized surface comprises greater than 1% Silicon.

25. The method according to claim 1, wherein the temperature of the passivation composition is between 55° C. and 65° C.

* * * * *